US005809715A

United States Patent [19]

Tanaka

[11] Patent Number: 5,809,715

[45] Date of Patent: Sep. 22, 1998

[54] PANEL

[75] Inventor: Shigekazu Tanaka, Kyoto, Japan

[73] Assignee: Kokuyo Co., Ltd., Osaka, Japan

[21] Appl. No.: 860,115

[22] PCT Filed: Nov. 15, 1996

[86] PCT No.: PCT/JP96/03352

§ 371 Date: Jun. 19, 1997

§ 102(e) Date: Jun. 19, 1997

[87] PCT Pub. No.: WO97/18362

PCT Pub. Date: May 22, 1997

[30] Foreign Application Priority Data

Nov. 15, 1995 [JP] Japan ..... 7-296647

[51] Int. Cl.[6] ..... E06B 3/12; E06B 9/00

[52] U.S. Cl. ..... 52/239; 52/782.2; 52/792.1; 160/236

[58] Field of Search ..... 52/239, 238.1, 52/656.9, 796.1, 796.11, 782.2, 782.21, 481.2, 762, 775, 780, 792.1; 160/135, 351, 236; 40/457, 489

[56] References Cited

U.S. PATENT DOCUMENTS

| | | | |
|---|---|---|---|
| 2,681,261 | 6/1954 | Blink | 52/782.2 X |
| 3,075,621 | 1/1963 | Attwood | 52/775 X |
| 3,676,279 | 7/1972 | Beaver | 52/782.2 X |
| 4,067,167 | 1/1978 | Anderson | 52/796.11 |

FOREIGN PATENT DOCUMENTS

| | | |
|---|---|---|
| 57-12658 | 3/1982 | Japan . |
| 5-62608 | 8/1993 | Japan . |
| 6-504344 | 5/1994 | Japan . |
| 7-8669 | 3/1995 | Japan . |

*Primary Examiner*—Creighton Smith
*Attorney, Agent, or Firm*—Banner & Witcoff, Ltd.

[57] ABSTRACT

In order to eliminate the difficulty in properly shaping the corner of a panel body where the edge portions thereof meet perpendicularly to each other and beautifully finishing the curled portions of a cladding sheet which covers the panel body, the panel 2 comprises a panel body 3 made of sheet metal by plastic deformation of the edge portions of the sheet metal, and a cladding sheet 4 arranged to cover the panel body, with a cutout 35, 36 formed at each corner of the panel body, and a corner member 5, 6 made of resin is attached to each corner, so that the curved surface 54, 64 formed on the corner member 5, 6 when it was molded makes the curved surface 32*c*, 33*c* smoothly continuous to 34*c*.

2 Claims, 13 Drawing Sheets

PANEL

TECHNICAL FIELD

This invention relates to a panel for use as, for example, a partition or the like in an office room or the like.

TECHNICAL BACKGROUND

There is known a partition which comprises a self-standing frame having an opening into which a panel is detachably fitted. In particular, the panel is provided adjacent the upper and lower edges at the rear side thereof with elongated mounting members made of sheet metal, which engage the upper and lower edges of the opening of the frame thereby to fix the panel to the frame. In the partition of this construction, since the panel can be removed from the frame in a simple manner for easy exchange for different panels, the partition is available for use as a means which can conveniently be used for various purposes such as for changing the interior appearance of an office room by changing panel colors, or for adding to the function of the partition by fixing to it a panel having hooks to hang things on.

A panel of a conventional construction comprises a panel body made of sheet metal formed into a desired shape and a cladding sheet provided to cover the surface of the panel body. The panel body has its corners formed by shaping the sheet metal, while it is being bent or after it has been bent, in such a manner that the upper and lower edge portions of the sheet metal become continuous with the side edge portions thereof. When the edges are rounded to give good appearance to the panel, if the upper, lower and lateral side edge portions of the sheet metal are bent at the same time, it is difficult to form the corners of the panel into a proper shape and neatly finish the rounded portions of the cladding sheet which cover the corners. Therefore, practically the upper and lower edges or side edges alone can be rounded.

DISCLOSURE OF THE INVENTION

In order to solve the above problem, in accordance with the present invention, the corners of the panel are formed not by working a sheet metal but by providing each corner of the panel with a cutout, which is filled in by a separate member which can be molded with ease. When the crossing edge portions of a panel body are simultaneously rounded, by using such a separate member which can be shaped so as to be continuous to the edge portions of the panel body it is possible to effectively improve the quality of the finished corners of the panel body without complicating the manufacturing process of the panel.

The panel of the invention comprises a panel body made of a sheet metal by plastic deformation of the edge portions thereof, and a cladding sheet for covering the surface of the panel body, said panel body being provided at the corners thereof with a cutout, which is filled in by a corner member made of plastic material.

When the panel is to be removably fixed to the frame of a partition, in order to effectively prevent the number of component parts from increasing, the corner member may be formed with an integral engaging claw which engages the opening of the frame of the partition thereby to fix the panel to the frame removably therefrom.

In the panel of the above construction, when the upper, lower, and lateral side edge portions of the sheet metal of the panel body are simultaneously formed into a rounded shape, the corner members are interposed between the adjacent end portions of the upper, lower and lateral side edges so as to render the rounded surfaces of the end portions smoothly continuous, so that when the panel body is covered with a cladding sheet, it is possible to beautifully finish the curved portions of the cladding sheet at the corners of the panel body thereby to improve the design and appearance of the panel easily and effectively.

The panel of the invention of the above construction has the following effects and advantages.

First, the panel of the invention comprises a panel body, a cladding sheet provided at such a position as to cover the surface of the panel body, with a cutout provided at each corner of the panel body, and a corner member of resin provided to fill in the cutout. In this construction, if the horizontal and vertical edge portions of the panel crossing perpendicularly to each other are rounded simultaneously, it is easily possible by molding to form on the corner members to be provided in the crossing portions a curved surface to render the rounded edge surfaces smoothly continuous. Thus the invention has the advantage that with a simplified operation of plastic deformation, it is possible to finish the curved portions of the cladding sheet at the corners of the panel body beautifully thereby to improve the design and appearance of the panel simply and very effectively.

Since the corner members are formed with the integral engaging claws for removably mounting the panel to the opening of the frame of a partition, there is no need to attach separate claws to the panel, so that the number of the manufacturing steps and the cost involved are advantageously reduced.

BEST MODES OF EMBODYING THE INVENTION

Figure 1:
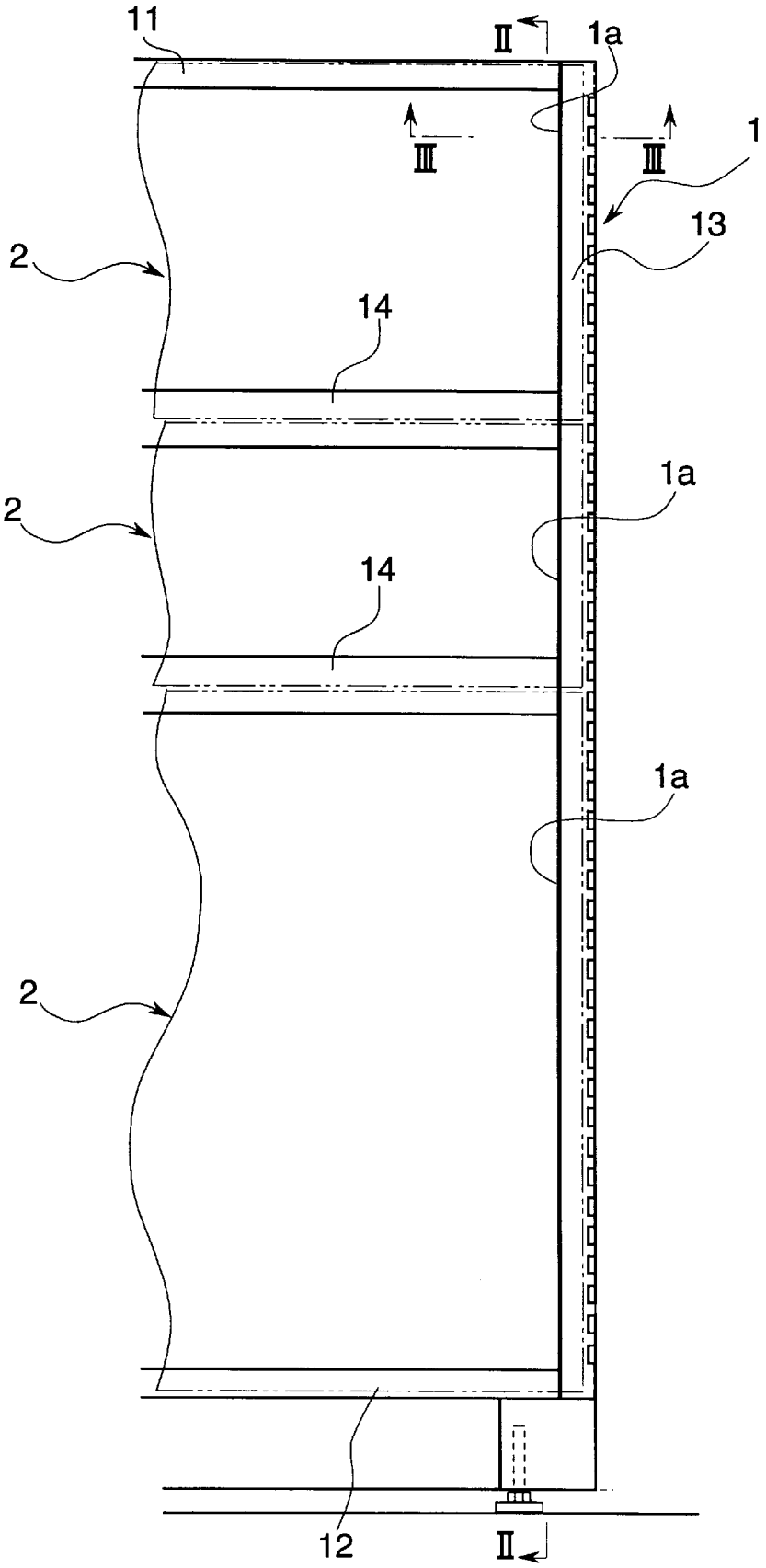
FIG. 1 is a front view of a partition which uses the panels constructed in one embodiment of the invention.
Figure 2:
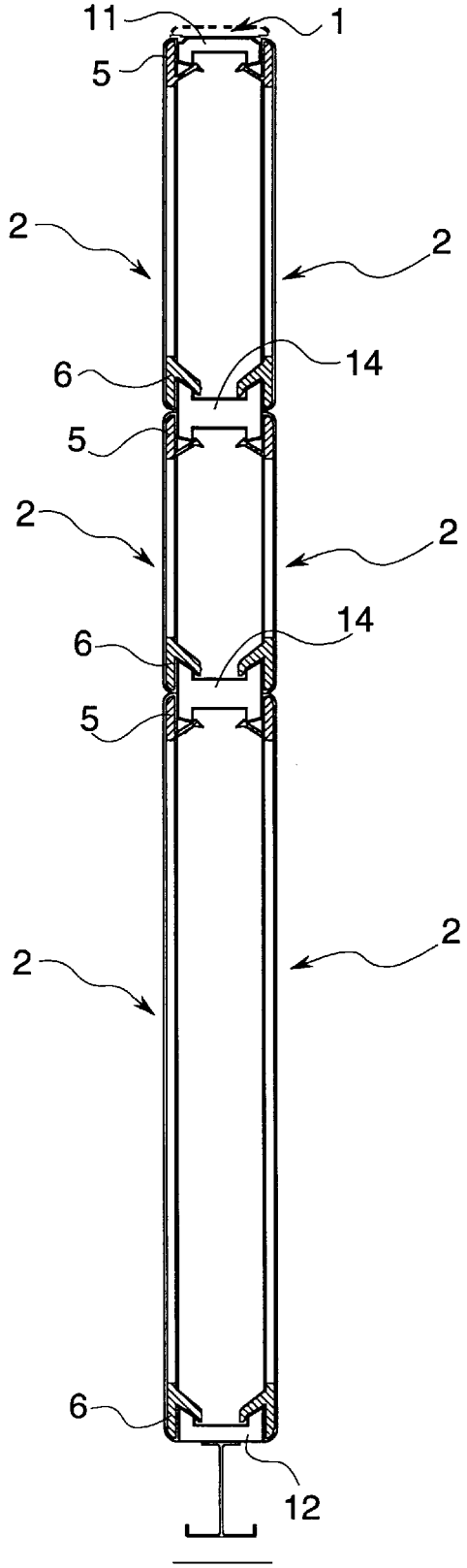
FIG. 2 is a sectional view taken along line II—II in FIG. 1.
Figure 3:
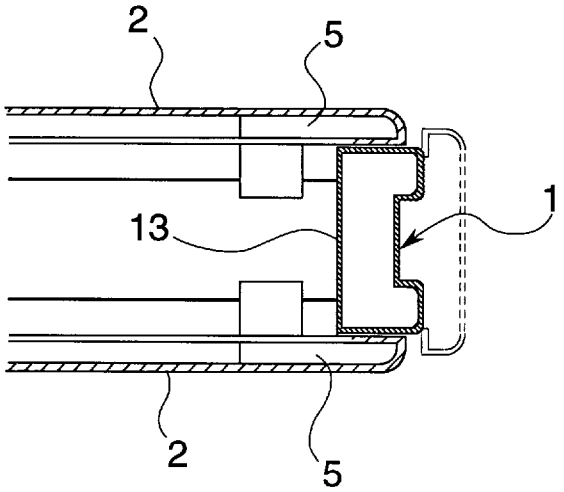
FIG. 3 is a sectional view taken along line III—III in FIG. 1.

One embodiment of the invention will be described with reference to the accompanying drawings, in which FIGS. 1 through 3 show a low partition having a relatively small height which is used to define in an office room a space including a desk or a space for reception of guests visually separated from the surrounding space. The low partition comprises a self-supported frame 1 having an opening 1*a* and a panel 2 fitted into the opening removably therefrom.

Figure 4:
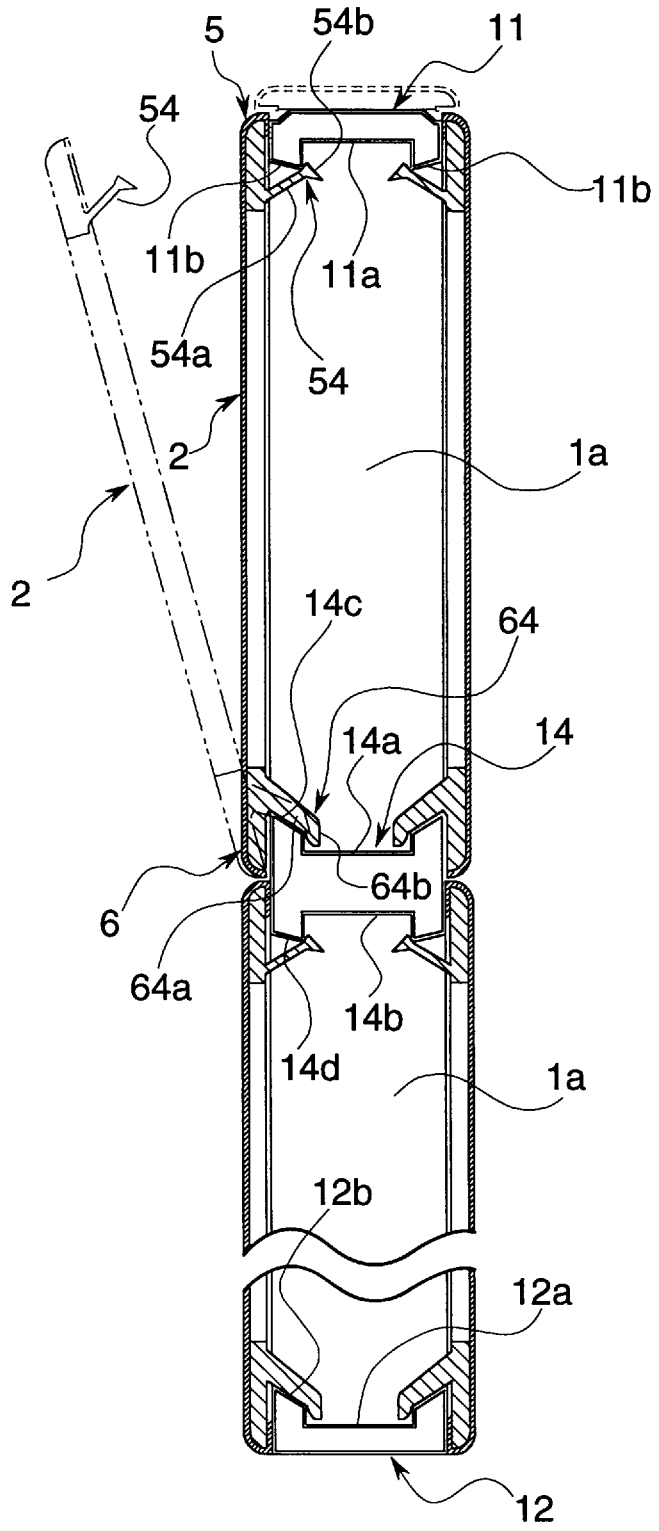
FIG. 4 is an enlarged view of a principal portion of FIG. 2.

The frame 1 comprises a top frame component 11, a bottom frame component 12, and right and left side components 13, 13 assembled with horizontal beams 14 connecting the side components 13 and 13 at vertically spaced apart elevations. The horizontal beams 14 are made by extrusion molding and, as shown enlarged in FIG. 4, provided with an upper and an under flat face 14*a* and 14*b* extending longitudinally in parallel with each other. Along the side edges of the upper flat face 14*a* there are formed an opposite pair of upward projections 14*c* each having an upper tapered face gradually lowering toward the center of the flat face. Along the side edges of the under flat face 14*b* there are formed an opposite pair of downward projections 14*d* each having an under tapered face also gradually lowering toward the center of the bottom flat face 14*b*.

The top frame component 11 is formed by extrusion molding into a channel member invertedly U-shaped and provided with an upper flat face 11*a*, along the opposite side edges of which there are formed a pair of projections 11*b* of the same configuration as the projections 14*d* on the previously described horizontal beam 14. The bottom frame component 12 is formed also by extrusion molding into a U-shaped channel member provided with an upward flat face 12*a*, along the opposite side edges of which there are formed a pair of projections 12*b* of the same configuration as the projections 14*c* on the previously described horizontal beam 14.

Figure 5:
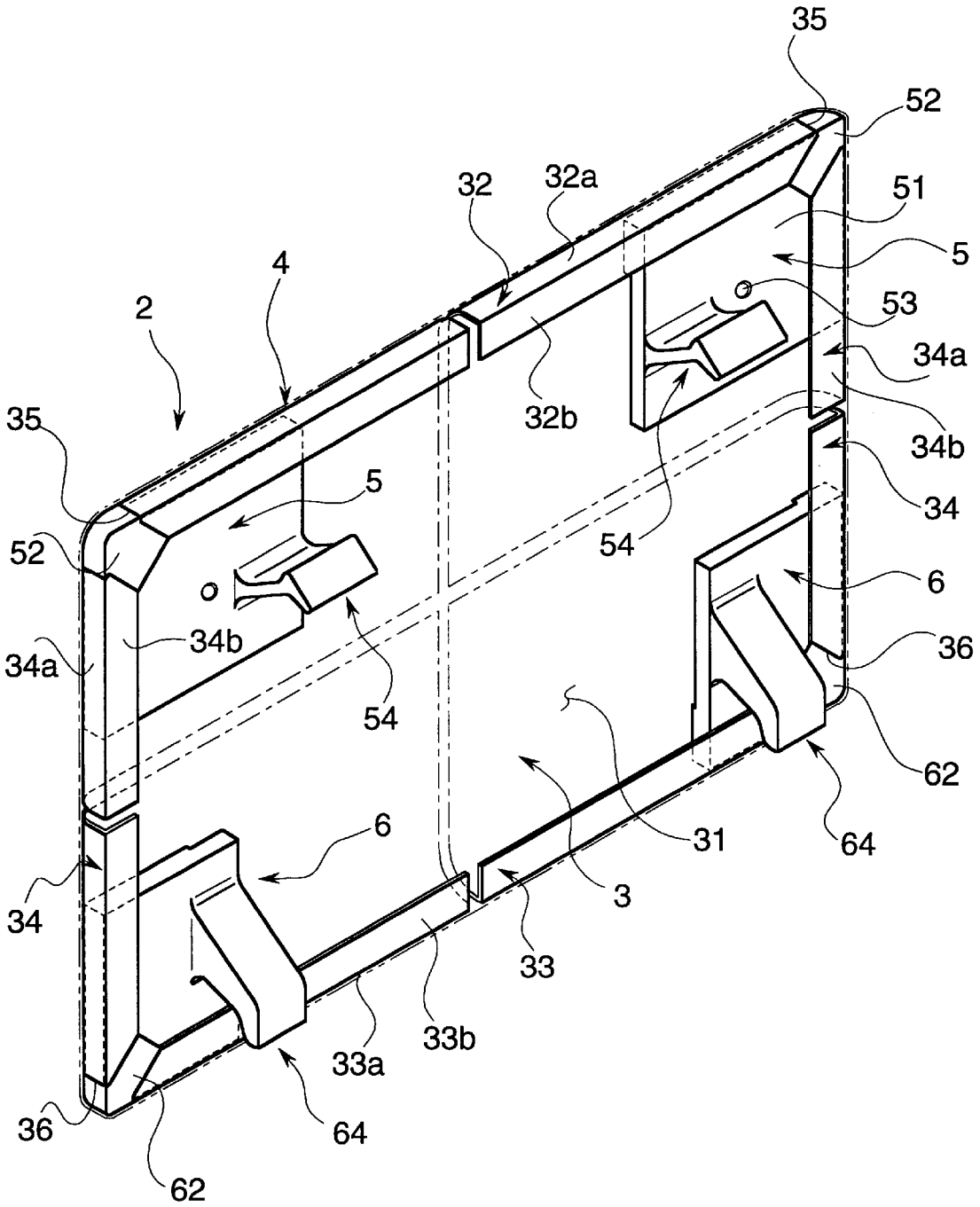
FIG. 5 is a perspective view of the panel of the same embodiment as viewed from the rear side thereof.
Figure 6:
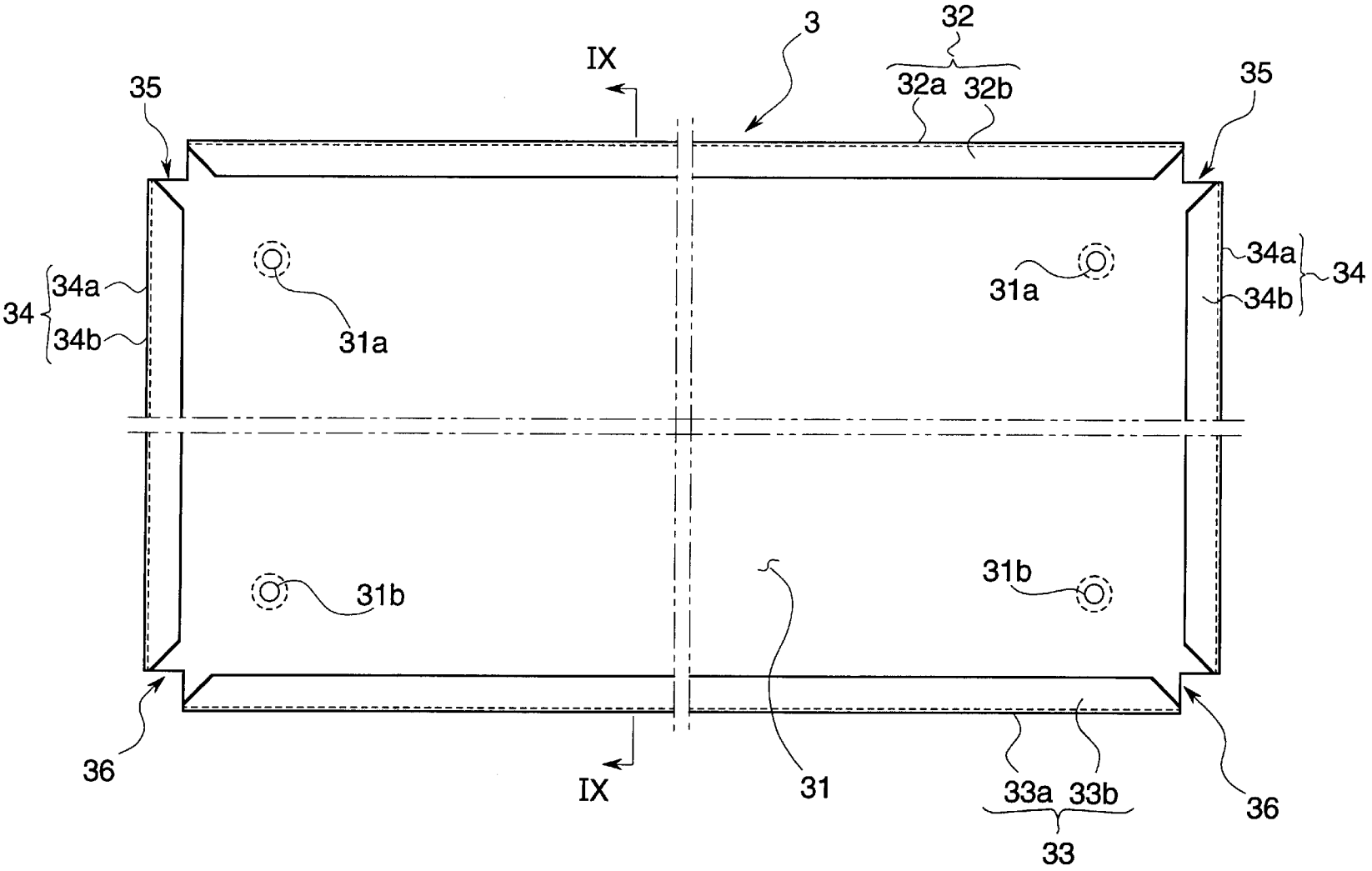
FIG. 6 is a rear view of the panel body constituting the panel.
Figure 7:
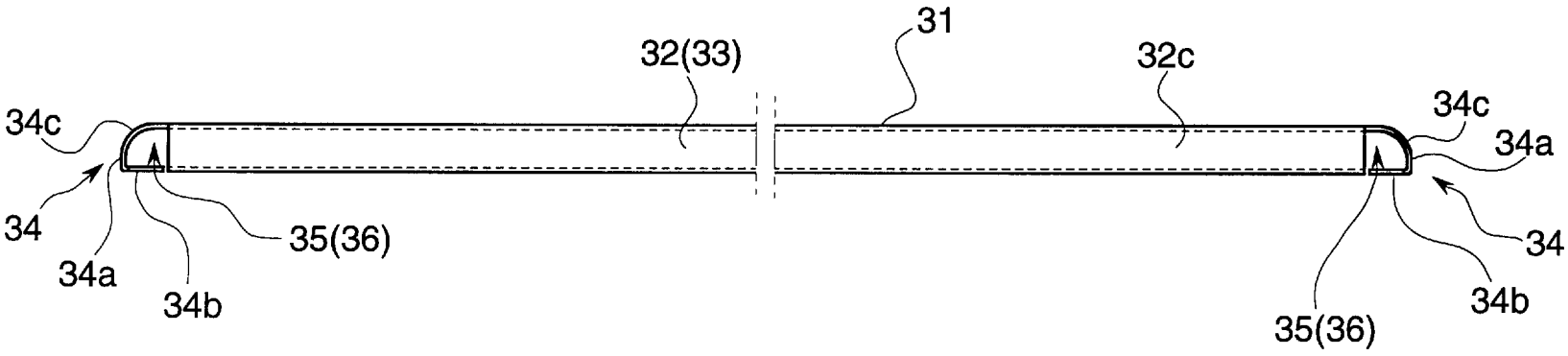
FIG. 7 is a top plan view of FIG. 6.
Figure 8:
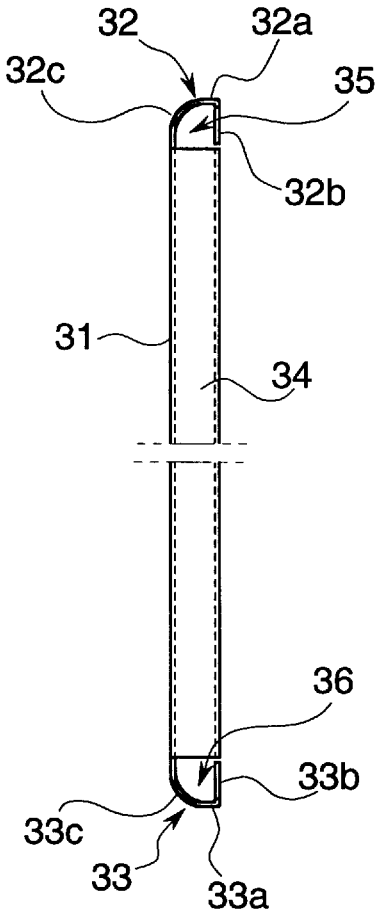
FIG. 8 is a left side view thereof.
Figure 9:
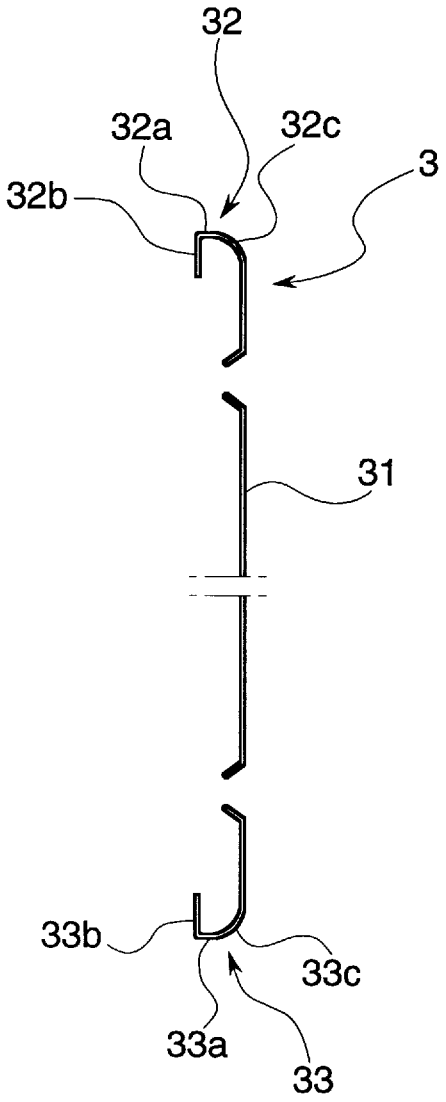
FIG. 9 is a sectional view taken along line IX—IX in FIG. 6.

As shown in FIG. 5, each panel 2 comprises a body 3 and a cladding sheet 4. As shown in FIGS. 6 through 9, the panel body 3 is made of sheet metal and comprises a flat front face portion 31, upper and lower channeled portions 32 and 33 formed by bending the upper and lower edge portions of the sheet metal, and right and left side channeled portions 34 formed by bending the lateral side portions of the sheet metal. In particular, the channeled portions 32 and 33 are formed by roll forming and have an upper face portion 32*a* (or an under face portion 33*a*) and a rear face portion 32*b* (or 33*b*), with a curved or rounded face portion 32*c* (or 33*c*) along the border between the front face portion 31 and the upper face portion 32*a* (or the under face portion 33*a*). The side channeled portions 34 are formed by, for example, pressing and each have a lateral side face portion 34*a* and a rear face portion 34*b*, with a curved or rounded face portion 34*c* along the border between the front face portion 31 and the side face portion 34*a*. At the four corners of the panel body 3, and more particularly, at the crossing portions of the opposite ends of the upper face portion 32*a* and the upper ends of both lateral side face portions 34*a* and at the crossing portions of the opposite ends of the under face portion 33*a* and the lower ends of both lateral side face portions 34*a* there are formed cutouts 35 and 36. The cutouts 35 are composed of a square opening in the front face portion 31 of the panel body 3, a partially rounded, partially square opening in the upper and lateral side face portions 32*a* and 34*a* of the channeled portions 32 and 34 of the panel body 3, and an opening of a certain width defined by edges extending at an angle of 45° in the rear face portions 32*b* and 34*b* of the upper channeled portion 32 and the lateral side channeled portions 34 of the panel body. Similarly, the cutouts 36 are composed of a square opening formed in the front face portion 31 of the panel body 3, a partially rounded, partially square opening formed in the under and lateral side face portions 33*a* and 34*a*, and an opening of a certain width defined by edges extending at an angle of 45° in the rear face portions 33*b* and 34*b*.

As shown in FIG. 5, the corner members 5 and 6 are provided to fill in the cutouts 35 and 36.

Figure 10:
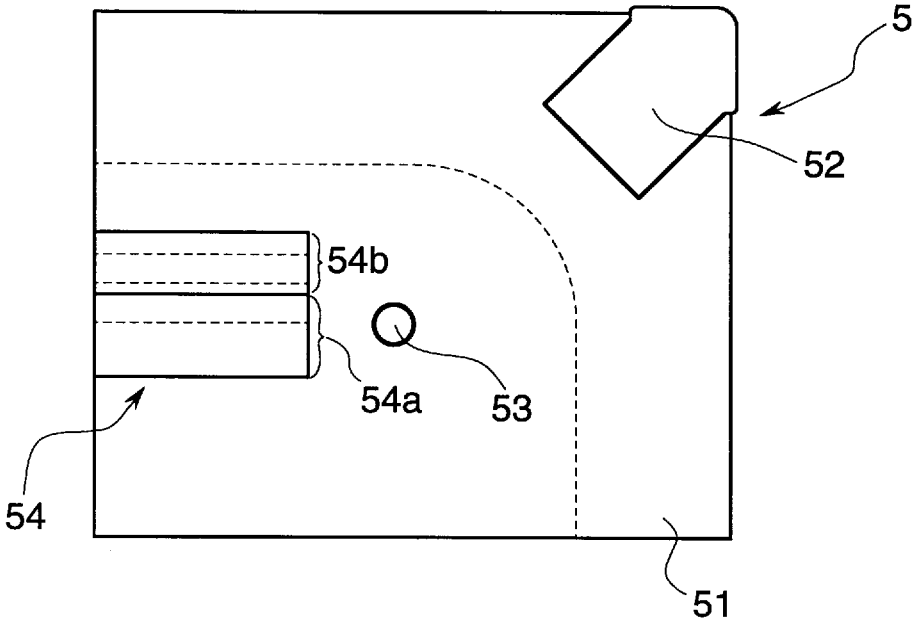
FIG. 10 is a rear view of the corner member used in the same embodiment.
Figure 11:
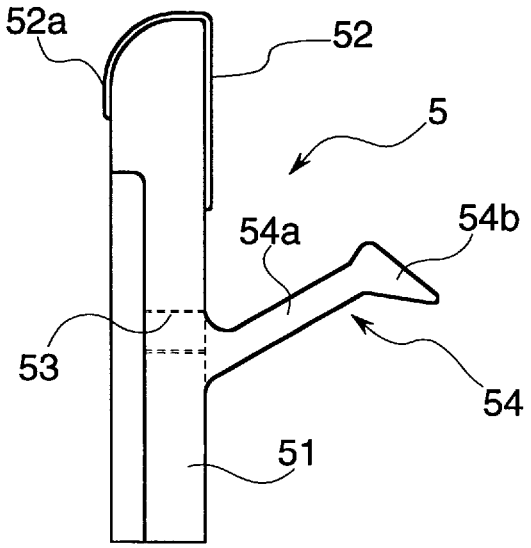
FIG. 11 is a left side view of FIG. 10.
Figure 12:
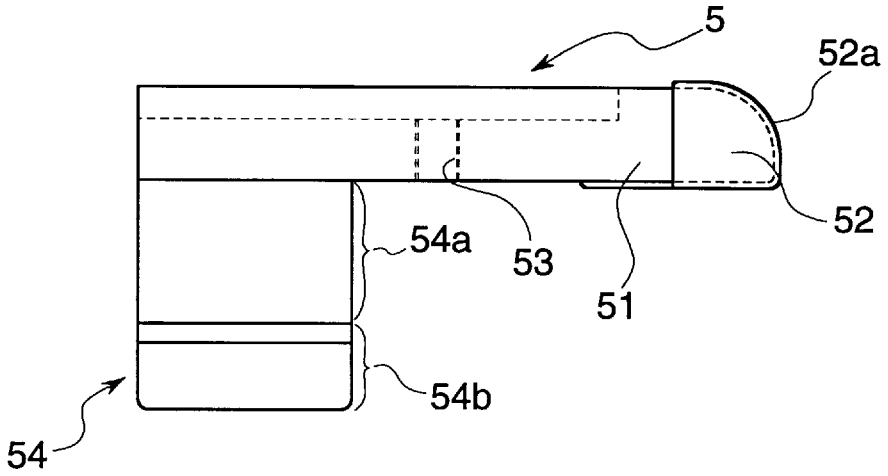
FIG. 12 is a top plan view thereof.
Figure 13:
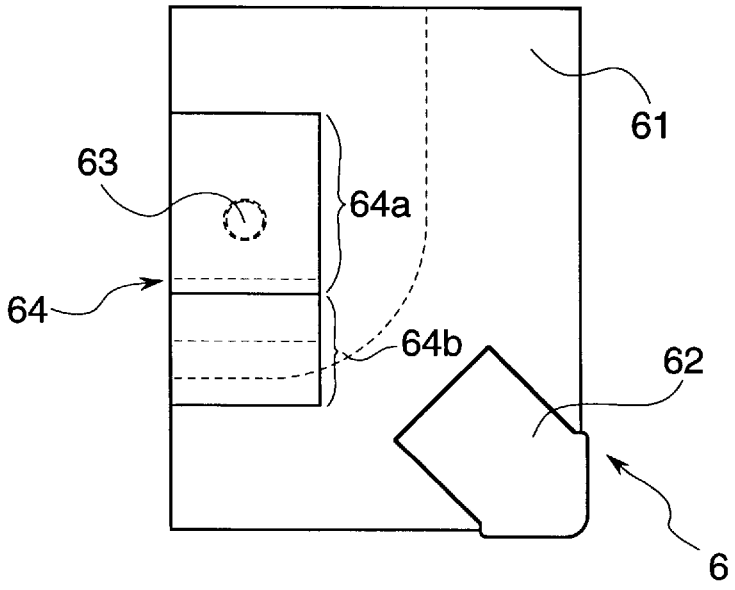
FIG. 13 is a rear view of the lower corner member used in the same embodiment.
Figure 14:
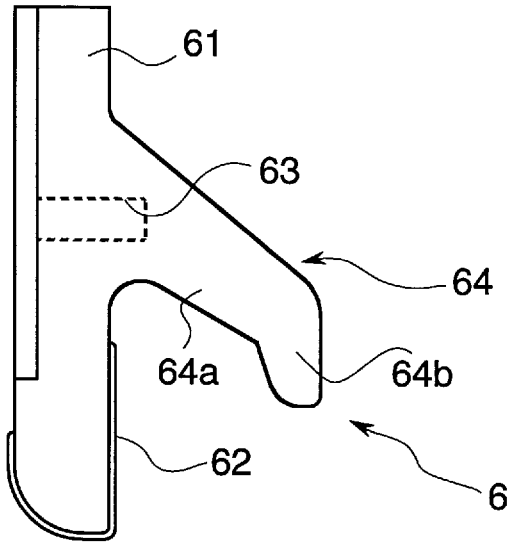
FIG. 14 is a left side view of FIG. 13.
Figure 15:
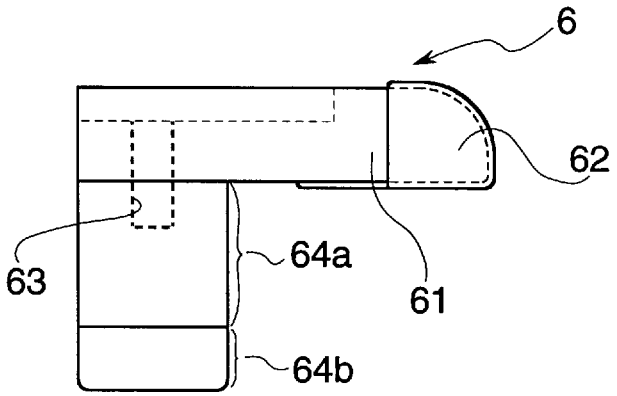
FIG. 15 is a top plan view thereof.

The corner member 5 is formed of plastic material by molding and comprises, as shown in FIGS. 10 through 12, a plane plate-like portion 51 rectangular in plan view and having a thickness substantially equal to the inner dimension between the front face portion 31 and the rear face portions 32*b* and 34*b* of the panel body 3, and a plug-like portion 52 having a shape corresponding to that of the cutout 35 and formed at one of the four corners of the plate-like portion 51 so as to project a height corresponding to the thickness of the panel body 3 at the outer sides of the front, rear, upper and lateral side face portions 31, 32*b*, 32*a* and 34*a* of the panel body 3. A through bore 53 is formed about the center of the plate-like portion 51. In a similar manner, the corner member 6 is formed of plastic material by molding and comprises, as shown in FIGS. 13 through 15, a plane plate-like portion 61 rectangular in plan view and having a thickness substantially equal to the inner dimension between the front face portion 31 of the panel body 3 and the rear face portions 33*b* and 34*b* thereof, and a plug-like portion 62 having a shape corresponding to that of the cutout 36 and formed at one of the four corners of the plate-like portion 61 so as to project a height corresponding to the thickness of the panel body 3 at the outer sides of the front, rear, under and lateral side face portions 31, 32*b*, 33*a* and 34*a* of the panel body 3. A through bore 63 is formed in the plate-like portion 61 about the center thereof.

The corner members 5 and 6 are fixed to the panel body 3 by means of a screw screwed into the threaded through bore 53, 63 in the corner member 5, 6 coinciding with a threaded bore 31*a*, 31*b* formed in the front face portion 31 of the panel body 3, with the peripheral portions along the two sides of each of the plate-like portions 51 and 61 of the corner members filling in the spaces between the front face portion 31 of the panel body 3 and the rear face portions 32*b* or 33*b* and 34*b* thereof, and the plug-like portions 52 and 62 filling in the cutouts 35 and 36. The plug-like portion 52 is previously formed with a curved surface portion 52*a* which connects the curved surfaces 32*c* and 34*c* of the panel body 3 so as to be smoothly continuous to each other. In a similar manner, the plug-like portion 62 is previously formed with a curved surface portion 62*a* which connects the curved surfaces 33*c* and 34*c* of the panel body 3 so as to be smoothly continuous to each other(see FIG. 16).

On the corner members 5 and 6 there is integrally formed of plastic material by molding an engaging claw 54, 64 for removably fixing the panel 3 to the opening 1*a* of the frame 1 shown in FIG. 1. As shown in FIGS. 10 through 12, the claw 54 comprises a proximal portion 54*a* extending rearwardly of the corner member 5 and upwardly aslant, and a distal portion 54*b* extending form the outer end of the proximal portion 54*a* both upwardly and rearwardly downwardly aslant. The claw 54 is relatively thin and as a whole can be resiliently deformed relatively easily. On the other hand, as shown in FIGS. 13 through 15 the claw 64 comprises a proximal portion 64*a* extending rearwardly of the corner member 6 and downwardly aslant, and a distal portion 64*b* extending straight from the outer end of the proximal portion 64*a* vertically downward. The claw 64 is relatively thick as compared with the claw 54 and has a strength to make it resistive to resilient deformation.

The panel body 3 is finished by covering the front face with a cladding sheet 4 which is fixed by using suitable means such as a tucker to the rear face of the panel body.

When the panel 2 is to be attached to the frame 1 in the opening 1*a* between the horizontal beams 14 as shown in FIG. 4 in imaginary line, the panel 2 is held with its upper portion slightly inclined forwardly and the under surface of the lower claw 64 extending from the proximal portion 64*a* to the distal portion 64*b* thereof are brought into engagement with the upper surface of the projection 14*c* on the horizontal beam 14. The panel 2 is then turned on the portion of engagement as a supporting axis until the upper engaging claw 54 abuts on the downwardly facing projection 11*b* on the top frame component 11, and then the panel is pushed in with a finger on the upper edge thereof, whereupon the distal portion 54*b* as well as the proximal portion 54*a* of the claw 54 are slightly resiliently deformed so as to pass the downwardly facing projection 11*b*, beyond which the claw 54 is restored to the original condition, so that the distal portion 54*b* of the claw 54 engages the inner surface of the projection 11*b*. Under the condition, the distal portion 64*b* of the lower claw 64 also engages the inner surface of the projection 14*c* thereby to securely fix and hold the panel 2 in the opening 1*a,* so that the panel is prevented from falling off the opening 1*a* unless an operating force in the reverse direction is applied to the panel 2.

Figure 16:
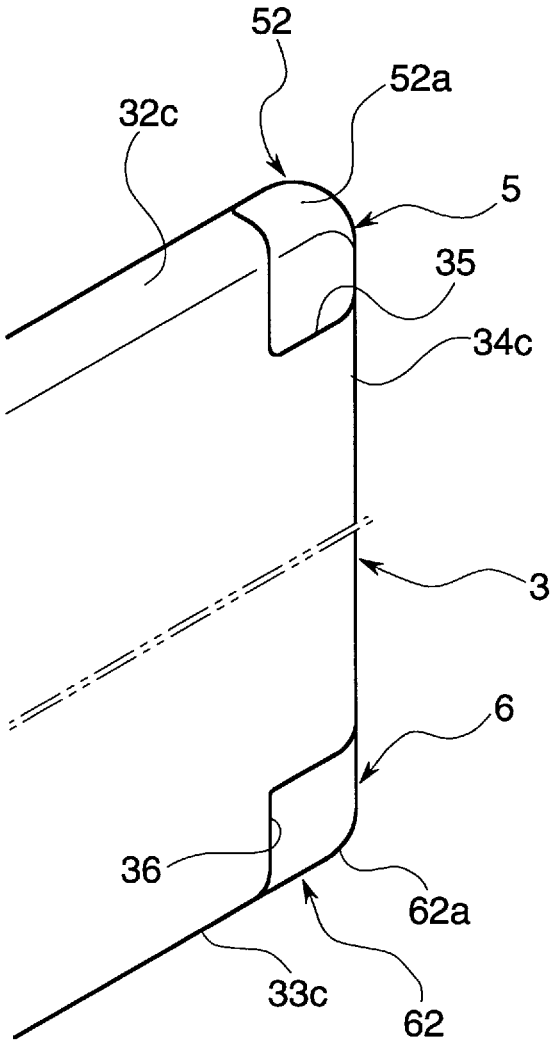
FIG. 16 is a frontal perspective view of the panel body of the same embodiment.

Thus, in accordance with the invention, instead of working a sheet metal to shape the corners of a panel, the cutouts 35 and 36 are provided in the corners of the panel and the corner members 5 and 6 made of plastic material are fitted in the cutouts, so that as shown in FIG. 16, the curved surface 32*c* formed on the upper edge of the panel body and the curved surface 34*c* formed on the lateral side edge thereof are connected by the curved surface 52*a* of the intermediate corner member 5 to form a smooth, continuous curved surface, and the curved surface 33*c* formed on the bottom edge of the panel body and the curved surface 34*c* on the lateral side edge thereof are connected by the curved surface 62*a* of the intermediate corner member 6 to form a smooth, continuous curved surface. Thus, when the above assembly is covered with the cladding sheet 4, the portions thereof covering the corners can be finished beautifully thereby to simply and effectively improve the design and appearance of the panel 2.

From a different point of view, the above embodiment can be considered as such that the corner members 5 and 6 made of resin and having engaging claws 54 and 64 for fixing the panel 2 in the opening 1*a* of the frame 1 are formed integrally with the plug-like portions 52 and 62. In other words, the parts for fixing the panel in the opening 1*a* of the frame 1 can be utilized to finish the corners of the panel, so that without increasing the number of the component parts, the number of steps of manufacturing the panel body 3 and the corner members 5, 6, and the manufacturing costs, the design and appearance of the panel can be greatly improved.

The concrete arrangements of the component parts of the panel are not restricted to the illustrated embodiment, but there may be various modifications and changes without departing from the scope and spirit of the invention.

POSSIBILITY OF USE IN INDUSTRY

As described above, the panel in accordance with the invention is suitable for use as a partition or the like for partitioning a space in an office room, and can also be used as a decorative panel to be arranged beside an article of furniture at an intermediate place in a room.

I claim:

1. A panel comprising a panel body formed by plastically deforming edge portions of a sheet metal and a cladding sheet so arranged as to cover a surface of the panel body, and characterized by that the panel body is provided at each corner with a cutout, and that a corner member made of resin is provided to fill in the cutout and is covered with said cladding sheet.

2. The panel as described in claim 1 and characterized by that the corner member is formed with an integral engaging claw adapted to engage an opening of a frame thereby to fix the panel body to the frame removably therefrom.

* * * * *